US007218082B2

(12) United States Patent
Walter et al.

(10) Patent No.: US 7,218,082 B2
(45) Date of Patent: May 15, 2007

(54) COMPENSATION TECHNIQUE PROVIDING STABILITY OVER BROAD RANGE OF OUTPUT CAPACITOR VALUES

(75) Inventors: William Louis Walter, Lowell, MA (US); Joseph Sinohin Panganiban, Lowell, MA (US)

(73) Assignee: Linear Technology Corporation, Milpitas, CA (US)

( * ) Notice: Subject to any disclaimer, the term of this patent is extended or adjusted under 35 U.S.C. 154(b) by 352 days.

(21) Appl. No.: 11/038,041

(22) Filed: Jan. 21, 2005

(65) Prior Publication Data

US 2006/0164053 A1 Jul. 27, 2006

(51) Int. Cl.
*G05F 1/40* (2006.01)

(52) U.S. Cl. ..... 323/273

(58) Field of Classification Search ..... 323/273, 323/374, 275, 276, 279, 280
See application file for complete search history.

(56) References Cited

U.S. PATENT DOCUMENTS

| | | | | |
|---|---|---|---|---|
| 5,191,278 | A | 3/1993 | Carpenter | |
| 5,274,323 | A | 12/1993 | Dobkin et al. | |
| 5,686,821 | A | 11/1997 | Brokaw | |
| 5,770,940 | A * | 6/1998 | Goder | 323/282 |
| 5,850,139 | A | 12/1998 | Edwards | |
| 5,982,226 | A | 11/1999 | Rincon-Mora | |
| 6,188,211 | B1 | 2/2001 | Rincon-Mora et al. | |
| 6,300,749 | B1 * | 10/2001 | Castelli et al. | 323/273 |
| 6,333,623 | B1 | 12/2001 | Heisley et al. | |
| 6,690,147 | B2 | 2/2004 | Bonto | |
| 6,765,374 | B1 | 7/2004 | Yang et al. | |
| 6,960,907 | B2 * | 11/2005 | Poss | 323/316 |
| 7,030,596 | B1 * | 4/2006 | Salerno et al. | 323/282 |
| 2004/0046532 | A1 | 3/2004 | Menegoli et al. | |
| 2004/0104711 | A1 | 6/2004 | Scoones et al. | |

OTHER PUBLICATIONS

"LT1083/LT1084/LT1085 Fixed : 3A, 5A, 7.5 A Low Dropout Positive Fixed Rugulators." Linear technology, pp. 1-12.

* cited by examiner

*Primary Examiner*—Adolf Berhane
(74) *Attorney, Agent, or Firm*—McDermott Will & Emery LLP

(57) ABSTRACT

A disclosed amplifier and buffer circuit, for example for a linear voltage regulator, comprises an input gain stage, an integrator and a unity-gain output stage. An output stage compensation scheme enables stable operation over a broad range of output capacitance. For low to moderate output capacitance, the design of the output stage effectively pushes the output pole to high frequencies while an internal pole provided by the integrator is dominant and rolls off the gain at lower frequencies. For high output capacitance, an input impedance of the buffer couples the internal pole and output pole, such that the output pole becomes dominant while the internal pole gets pushed to higher frequencies, maintaining stability. This input impedance connection may utilize the base-emitter resistance of a bipolar junction transistor connected to the internal node, or the connection may use an MOS transistor and a separate RC circuit.

39 Claims, 7 Drawing Sheets

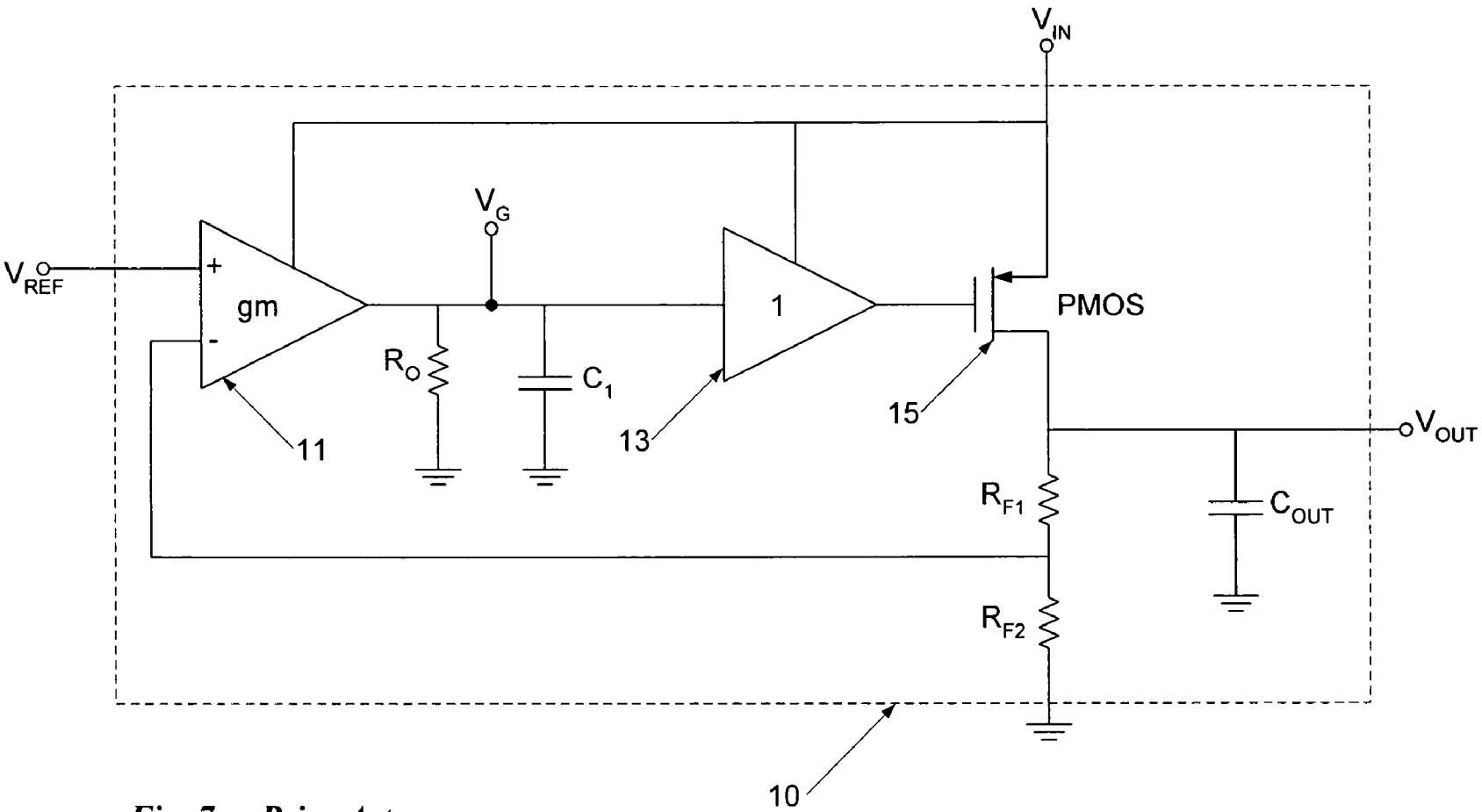
*Fig. 7 - Prior Art*

COMPENSATION TECHNIQUE PROVIDING STABILITY OVER BROAD RANGE OF OUTPUT CAPACITOR VALUES

TECHNICAL FIELD

The present subject matter relates to amplifier and buffer circuitry, for example for linear voltage regulators, stable over a broad range of output capacitor values.

BACKGROUND

Circuits comprising an amplifier and buffer find many applications in modern electronic devices. For example, voltage regulators based on such circuitry are used to supply a constant voltage source from an unregulated or regulated higher voltage supply. Low dropout (LDO) linear regulators are designed to allow a small voltage drop between the input supply and the regulated output voltage. LDOs thus decrease the headroom requirement and also increase power efficiency compared to linear regulators with high dropout architectures.

FIG. 7 shows a typical architecture for a low dropout linear regulator 10. The input stage is a differential gain stage consisting of a transconductance (gm) amplifier 11 driving a high impedance node ($V_G$) with a resistance $R_O$ in parallel with a capacitance $C_1$. The $V_G$ node is where the majority of the regulator's gain is established. Following the input gain stage is a buffer amplifier 13 to drive the high capacitive node of a pass element. For this architecture, a PMOS transistor 15 is used as the pass element to deliver current from the input supply to the regulator output. A resistor divider, $R_{F1}$ and $R_{F2}$, feeds back a divided voltage of the output to the non-inverting input terminal of the gm amplifier 11. This feedback regulates the output voltage to some multiple of $V_{REF}$ depending on the ratio of the feedback resistors. The LDO output ($V_{OUT}$) is bypassed by an output capacitor $C_{OUT}$.

Some of the specific challenges regarding the design of LDOs relate to its compensation. The frequency of the output pole ($P_{OUT}$) directly depends on the load current and is equal to $1/(2\pi*R_{O,PMOS}*C_O)$. $R_{O,PMOS}$ is the drain output resistance of the PMOS transistor pass device 15 and equals $V_A/I_{LOAD}$, where $V_A$ is the transistor Early voltage, and $I_{LOAD}$ is the output load current. Thus, $P_{OUT}$ can swing several decades depending on the load current swing, making the placement of the pole at $V_G$ ($P_G$) critical. If the frequencies of $P_G$ and $P_{OUT}$ lie too close together below crossover frequency, instability can occur.

One compensation strategy is to make $P_{OUT}$ the dominant pole. The non-dominant pole $P_G$, therefore, must lie beyond the maximum frequency of $P_{OUT}$ by at least the gain of the regulator for ample phase margin. This can lead to high operating currents, and often low loop gain to ensure $P_G$ is beyond crossover. Increasing the output capacitor value to guarantee that $P_{OUT}$ is at low enough frequencies for all load currents also can be unattractive due to increased cost and solution size.

Another strategy is to make $P_G$ the dominant pole by adding a compensating capacitor at $V_G$. $P_{OUT}$, therefore, must either lie beyond the crossover frequency, or a zero must be inserted (usually in the form of capacitor ESR) to counter the pole before crossover. The first case defines a minimum frequency requirement for $P_{OUT}$, placing constraints on the minimum load current and maximum output capacitor value. These constraints can be undesirable as they generally require significant quiescent load current and typically have poor transient response. The second case puts specific constraints on the type of output capacitor, and again requires a broadband $P_G$ pole beyond the output zero. These constraints can be undesirable for size, power consumption, cost, and transient response reasons.

SUMMARY

An amplifier-buffer circuit, such as used in a linear voltage regulator which is responsive to an input voltage to supply a regulated voltage to a load, implements an output stage configured with a compensation scheme providing stability of operations over a wide range of output capacitor values. The present teachings may be applied to amplifier and buffer circuits intended for a variety of applications, although discussion of examples will focus mainly on voltage regulators.

Hence, in several aspects, a circuit comprises an amplifier and an output stage, which may be a buffer. The amplifier monitors a voltage proportional to a signal output of the circuit to a load. In response, the amplifier generates an error signal indicative of a difference from a reference voltage. The output stage or the buffer is responsive to the error signal from the amplifier for processing an input signal to provide the signal output to the load. The output stage includes a metal oxide semiconductor (MOS) pass transistor having a source and a drain coupled between the input signal and the load. The gate of this transistor controls the voltage drop across the MOS pass transistor to provide the output signal to the load. The buffer or output stage also includes an input transistor circuit.

An example of this circuit, to implement a voltage regulator, which is operative over a range of capacitances at the output. The regulator comprises a control circuit, for monitoring a voltage proportional to voltage at the load to generate an error signal indicative of a difference from a reference voltage, and an output stage responsive to the error signal from the control circuit for providing the regulated voltage to the load. The output stage includes a metal oxide semiconductor (MOS) pass transistor having a source and a drain coupled between the input voltage and the load and a gate for controlling the voltage drop across the MOS pass transistor to provide the regulated voltage at the load. The output stage also includes an input transistor circuit responsive to the error signal coupled to control operation of the MOS pass transistor. This transistor circuit presents a shunt impedance to the error signal for values of the output capacitance within a portion of the range, so as to stabilize the closed loop gain of the voltage regulator over that portion of the range.

In the examples, the output stage is configured to have high bandwidth and a low output resistance. Several examples of the output stage use two MOS current mirrors, where the transistor serving as the pass element for the voltage regulator is an element of the second MOS current mirror. Other examples of the output stage use one or more resistor-transistor circuits. The high bandwidth and low output resistance of the output stage provide stability for low to moderate capacitance by pushing the output pole to high frequencies while an internal pole is dominant and rolls off the gain at lower frequencies. For high output capacitance, the shunt impedance couples the internal pole and output pole, such that the output pole becomes dominant while the internal pole gets pushed to higher frequencies, maintaining stability.

Two different examples of the transistor circuit of the output stage are described below. In one example, this circuit includes a bipolar junction transistor (BJT) having a base receiving the error signal. In this implementation, the base-emitter resistance of the BJT forms the shunt providing resistive shunting for higher values of output capacitance. The other example of the transistor circuit of the output stage uses an MOS transistor, with its gate receiving the error signal. In this second implementation, the transistor circuit of the output stage further comprises a series resistance and capacitance forming the shunt, connected to the gate of the MOS transistor.

In another aspect, a circuit may comprise an amplifier, an integration circuit and an output stage buffer. The amplifier has gain greater than unity and is coupled to the output signal. The integration circuit is coupled to the output of the amplifier. The output stage buffer processes an input signal in response to a signal from the integration circuit, to produce the output signal supplied to the load. The integrator and the output stage buffer are configured to stabilize the closed loop gain of the circuit over respective portions of a specified range of capacitance appearing at a connection of the output stage buffer to the load.

An example of such a circuit may serve as a voltage regulator, which comprises a high impedance amplifier responsive to a voltage supplied to the load for outputting an error signal, an integration circuit coupled to the error signal output of the amplifier, and a unity gain output stage. The unity gain output stage is coupled to the input voltage and supplies the regulated voltage to the load in response to the error signal received via the integration circuit. The integrator and the unity gain output stage stabilize the regulated voltage over respective portions of the range of output capacitance.

In the examples, the unity gain output stage has a high bandwidth and a low output resistance, so as to stabilize operation for low to moderate capacitance by pushing the output pole to high frequencies while an internal pole is dominant and rolls off the gain at lower frequencies. For high output capacitance, an input impedance of the output stage couples the internal pole and output pole, such that the output pole becomes dominant while the internal pole gets pushed to higher frequencies, maintaining stability.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present teachings may be realized and attained by practice or use of the methodologies, instrumentalities and combinations particularly pointed out in the appended claims.

BRIEF DESCRIPTION OF THE DRAWINGS

The drawing figures depict one or more implementations in accord with the present teachings, by way of example only, not by way of limitations. In the figures, like reference numerals refer to the same or similar elements.

FIG. 7 is a schematic diagram of a prior art low dropout linear voltage regulator.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

The present teachings are applicable to circuitry combining an amplifier and a buffer. Although there are many other applications for such circuits, for convenience, discussion of the examples below will focus on examples intended for use as voltage regulators, particularly linear voltage regulators.

Figure 1:
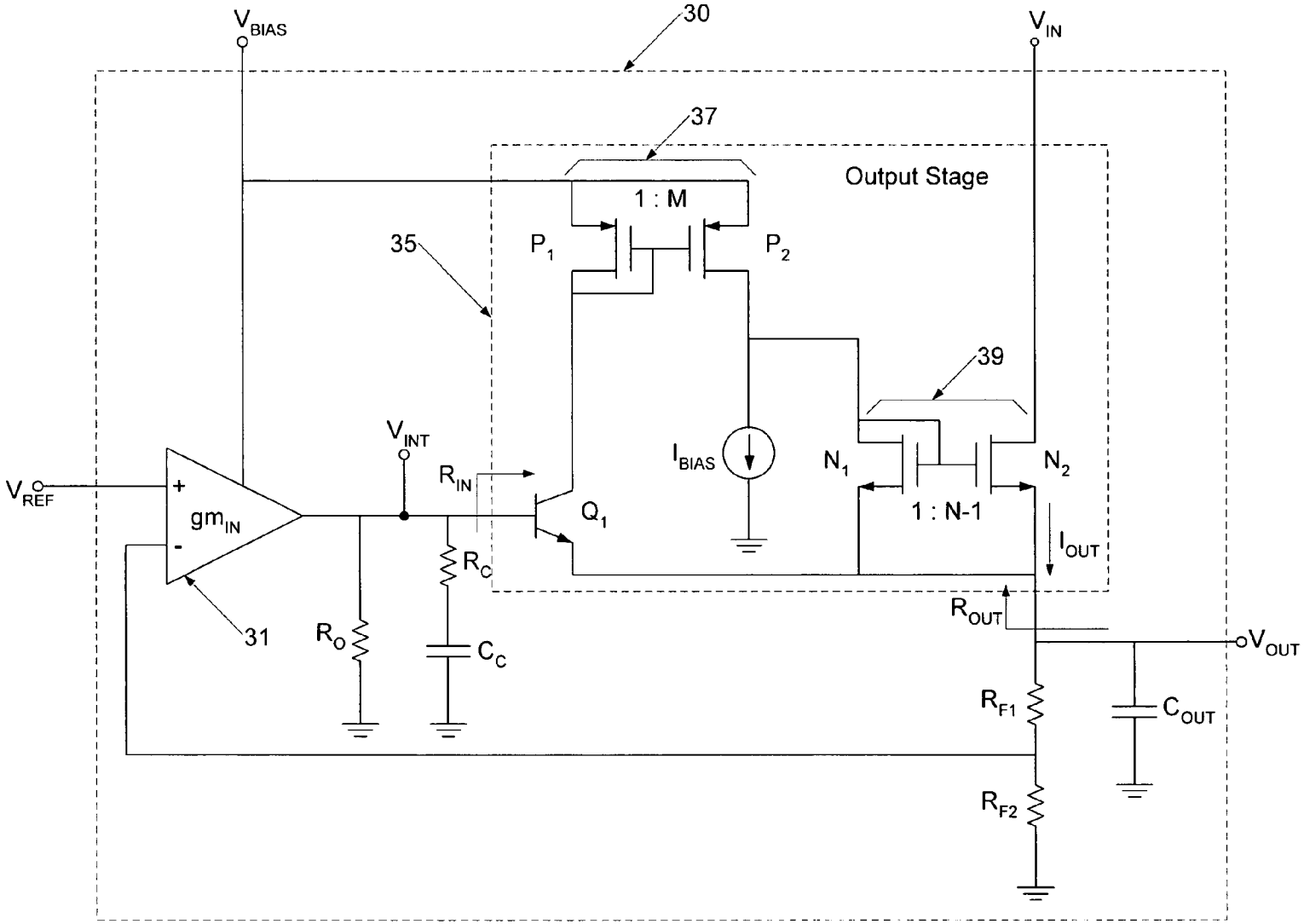
FIG. 1 is a schematic diagram of an example of a linear voltage regulator.

FIG. 1 is a schematic of a low dropout (LDO) linear voltage regulator 30. The regulator 30 comprises an input stage and an output stage. The input stage serves as a high gain amplifier, e.g. for uses as a control circuit for generating an error signal to control the output stage as a function of a voltage proportional to the load voltage. The output stage has unity gain and serves as a buffer.

The input gain stage includes a differential gm amplifier 31 feeding into a high impedance integrating node ($V_{INT}$) with output resistance $R_O$. A compensating capacitor and resistor ($R_C$ and $C_C$) are added to $V_{INT}$ as part of the compensation scheme. The input stage provides all the open-loop DC gain for the LDO 30, which equals $gm_{IN}*R_O$ with respect to gm amplifier 31's differential input. A resistor divider, $R_{F1}$ and $R_{F2}$, feeds back a divided voltage of the output to the non-inverting input terminal of the gm amplifier 31. This feedback regulates the output voltage to some multiple of $V_{REF}$ depending on the ratio of the feedback resistors. The LDO output ($V_{OUT}$) is bypassed by an output capacitor $C_{OUT}$.

The output stage 35 comprises a pass transistor N2 and stabilizing circuitry. The stage 35 essentially is a unity-gain amplifier (buffer) that includes the pass transistor element $N_2$ inside the loop and is responsive to the integrated error signal as it appears at node $V_{INT}$.

A bipolar junction transistor (BJT) $Q_1$ provides the connection between the input gain stage and output stage and serves as the input circuit for the stage 35. The base emitter resistance of the BJT contributes to the compensation scheme, which will be illustrated later. A later embodiment (FIG. 4) utilizes a MOS device for this input coupling transistor, but to provide the compensation, the input circuit there utilizes an additional shunt impedance.

As shown in FIG. 1, the output stage 35 utilizes two current mirror circuits 37 and 39. The first current mirror circuit 37 uses two P-type metal oxide semiconductor (PMOS) transistors $P_1$ and $P_2$. The second current mirror circuit 39 uses two N-type metal oxide semiconductor (NMOS) transistors $N_1$ and $N_2$. The base of $Q_1$ connects to the error signal output of the gain stage, and its collector current is mirrored by $P_1$ and $P_2$ with a mirror gain of M. The output of the PMOS mirror feeds into the second mirror 39 comprised of $N_1$ and $N_2$ with mirror gain N−1. NMOS transistor $N_2$ serves as the pass device for the LDO 30, with its source as $V_{OUT}$. The loop of the output stage is closed by tying $V_{OUT}$ back to the emitter of $Q_1$.

The high bandwidth and low output resistance of the output stage provide stability for low to moderate capacitance by pushing the output pole to high frequencies while an internal pole is dominant and rolls off the gain at lower frequencies. For high output capacitance, the shunt impedance couples the internal pole and output pole, such that the output pole becomes dominant while the internal pole gets pushed to higher frequencies, maintaining stability.

The LDO architecture of FIG. 1 includes an NMOS pass transistor $N_2$ in a source-follower configuration. To achieve low drop out operation (i.e. small $V_{IN}-V_{OUT}$), the gate of the pass device $N_2$ should be driven to a voltage higher than $V_{IN}$. Therefore, a separate but higher voltage supply $V_{BIAS}$ is needed to provide the appropriate NMOS gate voltage for low drop out operation. In the example of FIG. 1, for correct operation at full rated load current ($I_{OUT}$), $V_{BIAS}$ should be greater than $V_{IN}$ by at least: $(V_{BIAS}-V_{IN})\geqq(V_{SAT}(P2)+V_{GS}(N1)-V_{DROPOUT})$ There are various methods for generating the $V_{BIAS}$ supply voltage. In a first example, the user of the LDO regulator 30 could provide both $V_{IN}$ and $V_{BIAS}$ supplies through separate external power sources. Second, a DC to DC boost converter could be used to generate $V_{BIAS}$ from $V_{IN}$. Optimally the boost converter could be integrated on the same integrated circuit as the LDO regulator 30. The design of DC to DC boost converters is well documented and understood by those skilled in the art and is beyond the scope of this detailed description. As another example, the user may supply $V_{BAIS}$ and use a DC to DC buck converter to generate $V_{IN}$. Again the buck converter could optimally be included on the same integrated circuit as the LDO regulator 30. The benefit of such a configuration is that high efficiency power conversion is maintained from $V_{BIAS}$ to $V_{IN}$ while the LDO output will provide rejection from $V_{IN}$ ripple inherent in the DC to DC switching conversion process.

The current source $I_{BIAS}$ shown in the example of FIG. 1 may be included, to always have some collector current flowing in $Q_1$ even under no load conditions. When $I_{OUT}$ is zero, $Q_1$ is biased up with a collector current of $I_{BIAS}/M$. This ensures that $Q_1$ always has a finite base resistance for the compensation scheme to work, even under very low output current levels.

Figure 2:
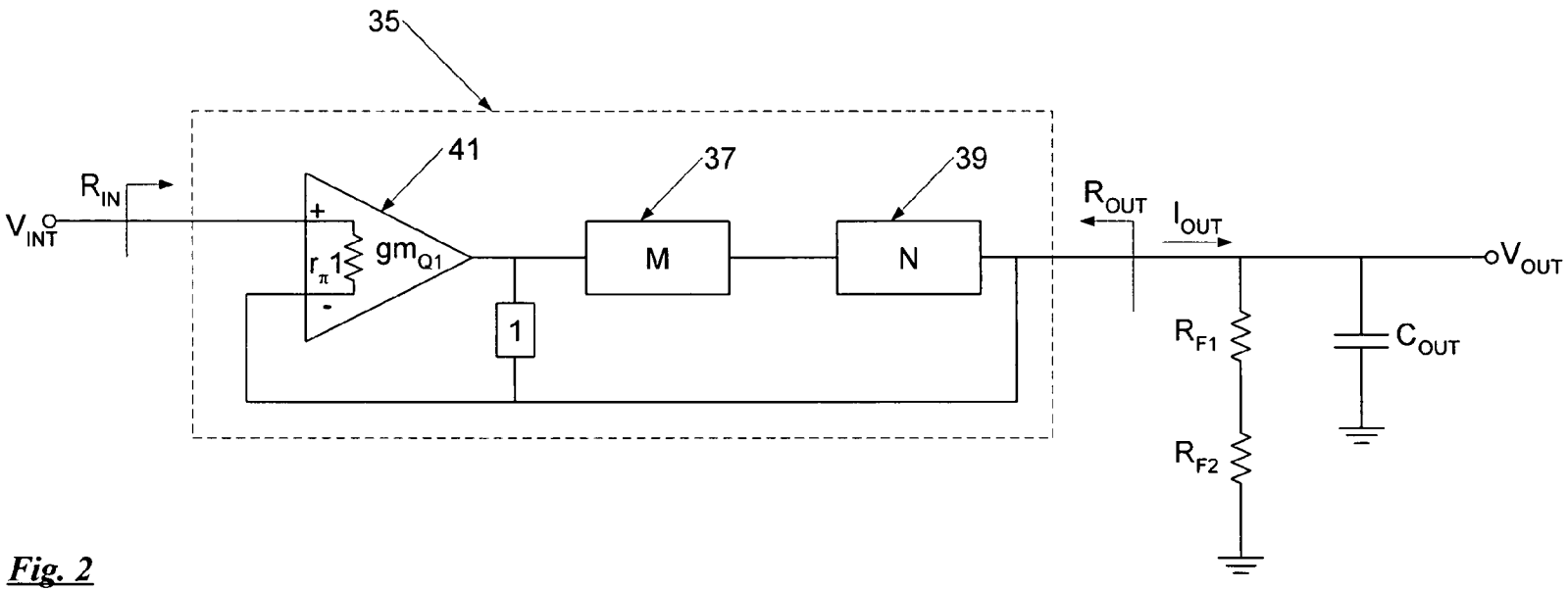
FIG. 2 is a functional block diagram useful in explaining the small-signal characteristics of the output stage of the regulator of FIG. 1.

The entire output stage can be imagined as its own feedback amplifier configured in unity-gain feedback, as shown by the small-signal block diagram in FIG. 2. Transistor $Q_1$ serves as the gm amplifier 41, with its base as the non-inverting input, its emitter as the inverting input, and its collector as the gm output. The small-signal collector current is multiplied by gains M and N, which represent the two mirror stages 37 and 39. Thus the total closed-loop transconductance gain of the output stage ($GM_{OS}$) from $V_{INT}$ to $I_{OUT}$ is equal to $gm_{Q1}(1+M*N)$. The closed-loop voltage gain, however, from $V_{INT}$ to $V_{OUT}$ is unity.

For small to moderate output capacitor values, the integrating node serves as the dominant pole and is equal to $P_{INT}=1/(2\pi*R_O*C_C)$. The non-dominant pole at $V_{OUT}$ is at much higher frequencies compared to conventional PMOS LDO architectures because of the smaller output resistance ($R_{OUT}$) at the source of $N_2$. This output resistance equals the inverse of the closed-loop transconductance of the output stage, which is equal to $R_{OUT}=1/GM_{OS}$. Therefore, the output pole is pushed to a value of $GM_{OS}/(2\pi*C_{OUT})$, where $GM_{OS}$ equals $gm_{Q1}(1+M*N)$. Thus the output stage provides a very low output resistance $R_{OUT}$, allowing the use of greater valued output capacitors at $C_{OUT}$ while maintaining adequate phase margin.

The implementation of the NPN bipolar junction transistor $Q_1$ helps sustain LDO stability, as the output capacitor value further increases towards infinity. $Q_1$'s base resistance $r_{\pi 1}$ plays a role in the compensation, as $C_{OUT}$ increases from moderate to very high capacitor values. For small to moderate-valued capacitors, the input resistance of the output stage ($R_{IN}$ in FIGS. 1–3) looks very high impedance, since the output stage acts like a voltage follower to $V_{OUT}$. However, as $C_{OUT}$ increases towards infinity, the impedance at the output node decreases and $V_{OUT}$ begins to behave as an incremental ground. Thus, the resistance $R_{IN}$ looking into the base of $Q_1$ no longer looks high impedance, but instead this resistance looks like the base resistance $r_{\pi 1}$ of transistor $Q_1$ providing a shunt connection to ground through $C_{OUT}$.

Figure 3:
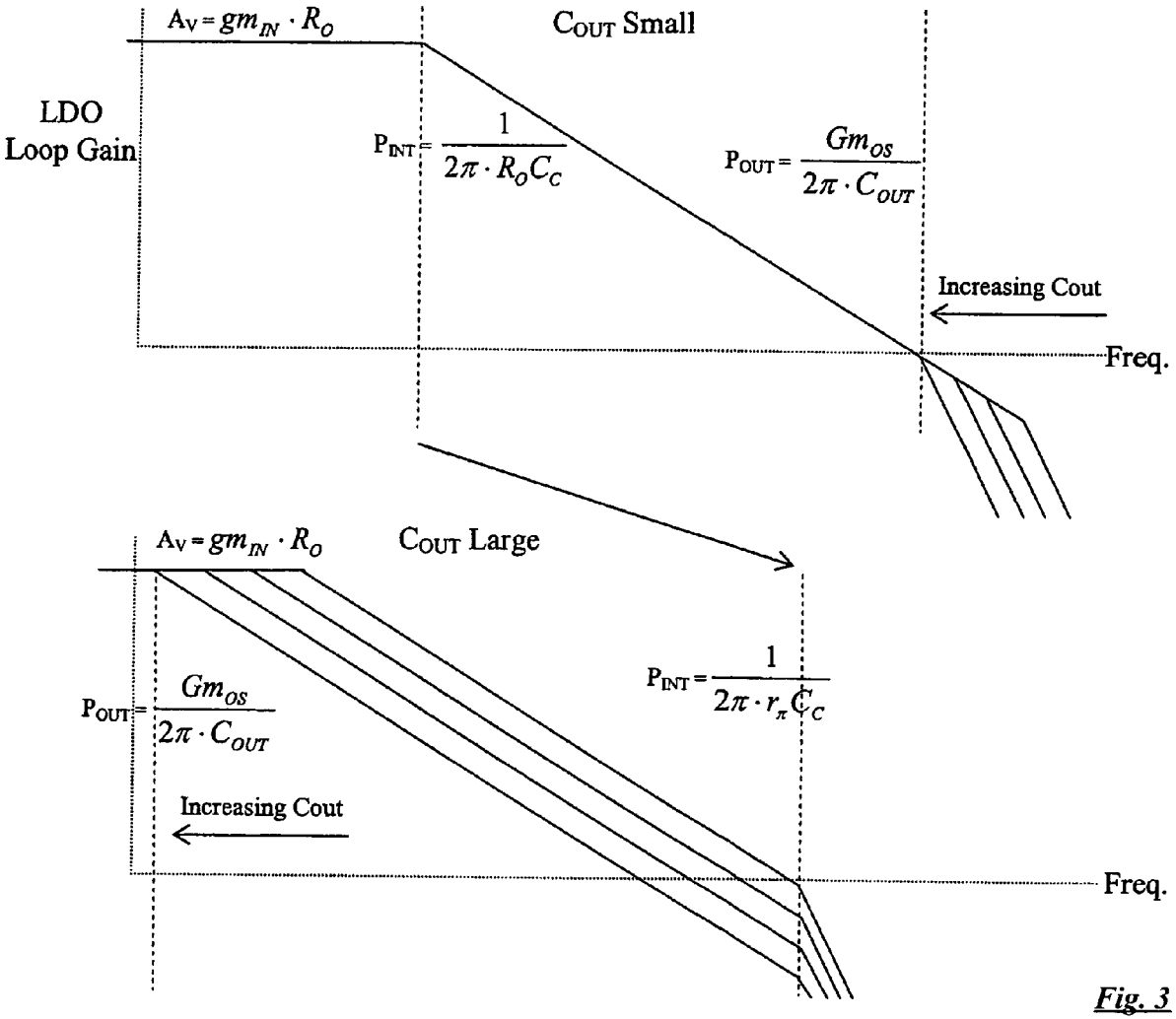
FIG. 3 is a Bode plot for the regulator of FIG. 1, with low and high $C_{OUT}$ values.

This base resistance shunting of the high resistance of the $V_{INT}$ node reduces the impedance of the internal node and pushes out the internal pole $P_{INT}$ to higher frequencies. Meanwhile, the output pole continues to travel to lower frequencies as $C_{OUT}$ increases. Eventually, the two poles swap roles. $P_{OUT}$ becomes the dominant pole while $P_{INT}$ is pushed out to a higher frequency equal to $1/(2\pi*r_{\pi 1}*C_C)$, where $r_{\pi 1}$ is equal to $Beta_{Q1}/gm_{Q1}$. FIG. 3 illustrates this change in compensation between low and high $C_{OUT}$ values.

This use of a BJT for $Q_1$ contributes to the compensation scheme because of the base resistance provided by that type of transistor. If a MOS device were used in place of $Q_1$, $P_{INT}$ and $P_{OUT}$ would be completely isolated from each other, since the gate resistance of a MOS device is virtually infinite. Thus, as $C_{OUT}$ increases, $P_{INT}$ stays fixed at $1/(2\pi*R_O*C_C)$ while $P_{OUT}$ travels to lower frequencies. Eventually, the stability of the regulator becomes compromised when $C_{OUT}$ reaches a value when $P_{OUT}$ and $P_{INT}$ are at the same vicinity.

Note that even with a BJT for $Q_1$, the above scenario can still occur resulting in marginal stability. This happens for intermediate $C_{OUT}$ values where $P_{OUT}$ and $P_{INT}$ cross over each other. The region where this occurs, however, is at much higher frequencies compared to the MOS case, because $P_{INT}$ moves out towards higher frequencies as $C_{OUT}$ increases for the BJT case. Because this region is at a higher frequency, a reasonable sized compensating resistor ($R_C$) can advantageously be inserted in series with the compensating capacitor $C_C$ at $V_{INT}$. This creates a zero in the frequency response that can easily be tuned to frequencies above the crossover region, creating additional phase margin.

Figure 4:
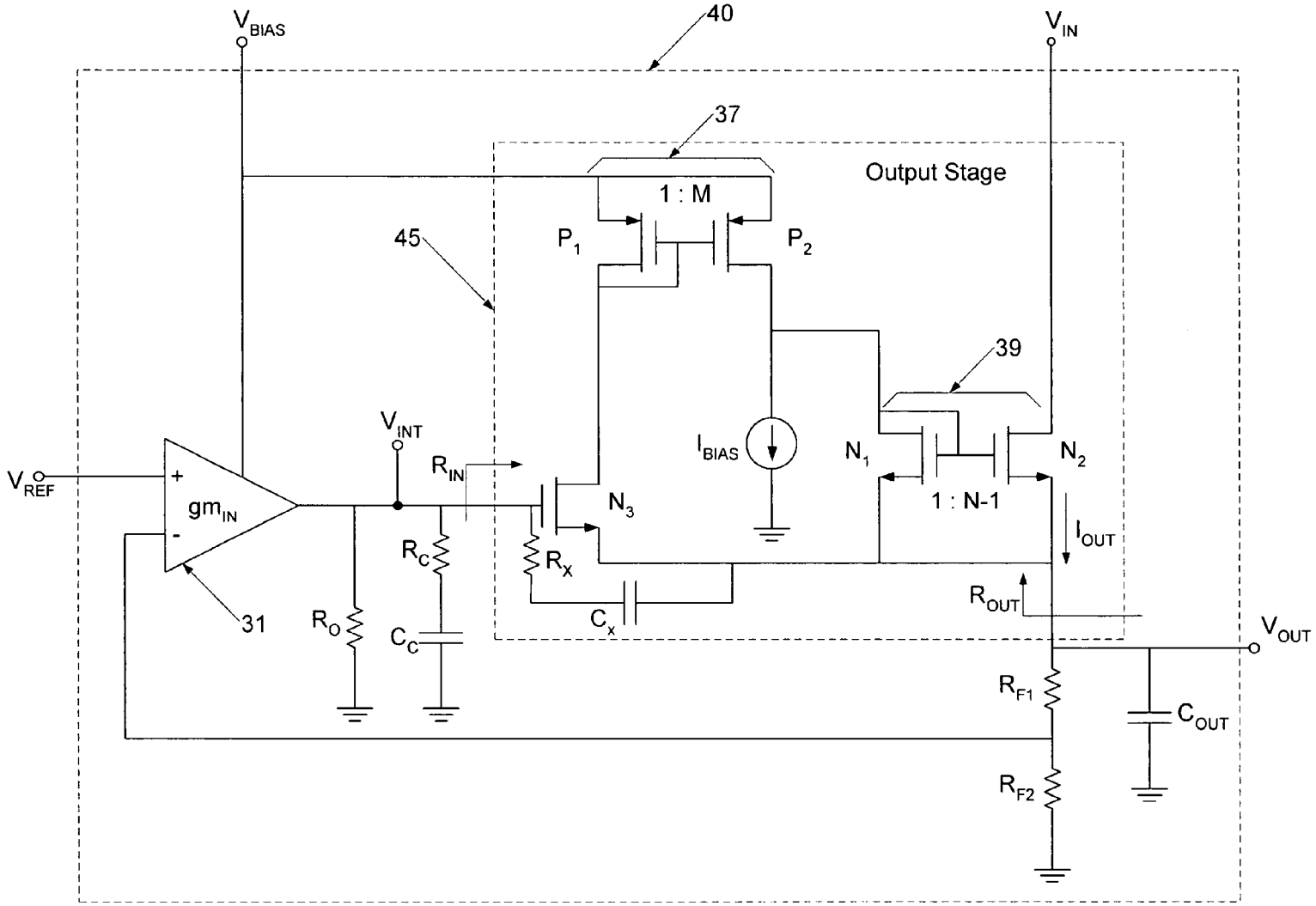
FIGS. 4–6 are schematic diagrams of several other examples of a linear voltage regulator.

An element of the compensation strategy in the example of FIG. 1 is the shunting of $V_{INT}$ by the intrinsic base resistance of $Q_1$. In that embodiment, $Q_1$ is a BJT type transistor. However, the compensation scheme may be implemented using other transistor types, but a different shunting is provided to implement the compensation scheme. FIG. 4 shows another embodiment 40 of an LDO, which is generally similar to the embodiment of FIG. 1, but substitutes a metal oxide semiconductor—field effect transistor (MOSFET), specifically NMOS transistor $N_3$ in the output stage 45, in place of the BJT input transistor $Q_1$. Otherwise, the LDO 40 is the same as the LDO 30, and like components are identified by the same reference characters.

As outlined above, a bare replacement of $Q_1$ with an MOS transistor would disrupt the compensation method, since a MOSFET has virtually infinite resistance looking into its gate. However, a shunting resistor that mimics the base resistance of $Q_1$ can be explicitly added around the MOS transistor $N_3$ so that the compensation scheme can work.

In the illustrated example, a series resistor-capacitor network is connected between $V_{INT}$ and $V_{OUT}$. $R_X$ resembles the shunting resistor for this case. The addition of series capacitor $C_X$ insures that the DC biasing of the output stage is not disrupted by $R_X$. For frequencies above DC, $C_X$ can be considered as a short circuit. Thus, the small signal model of the output stage 45 would look exactly like that of the output stage 35 in FIG. 2, and the compensation strategy would still apply. The disadvantage of this method over that of FIG. 1 is that $C_X$ could be substantially large for it to act like a short circuit for frequencies of interest.

However, the output stage 45 does provide substantially the same stability. Again the high bandwidth and low output resistance of the output stage provide stability for low to moderate capacitance by pushing the output pole to high frequencies while an internal pole is dominant and rolls off the gain at lower frequencies. For high output capacitance, the shunt impedance couples the internal pole and output pole, such that the output pole becomes dominant while the internal pole gets pushed to higher frequencies, maintaining stability.

Figure 5:
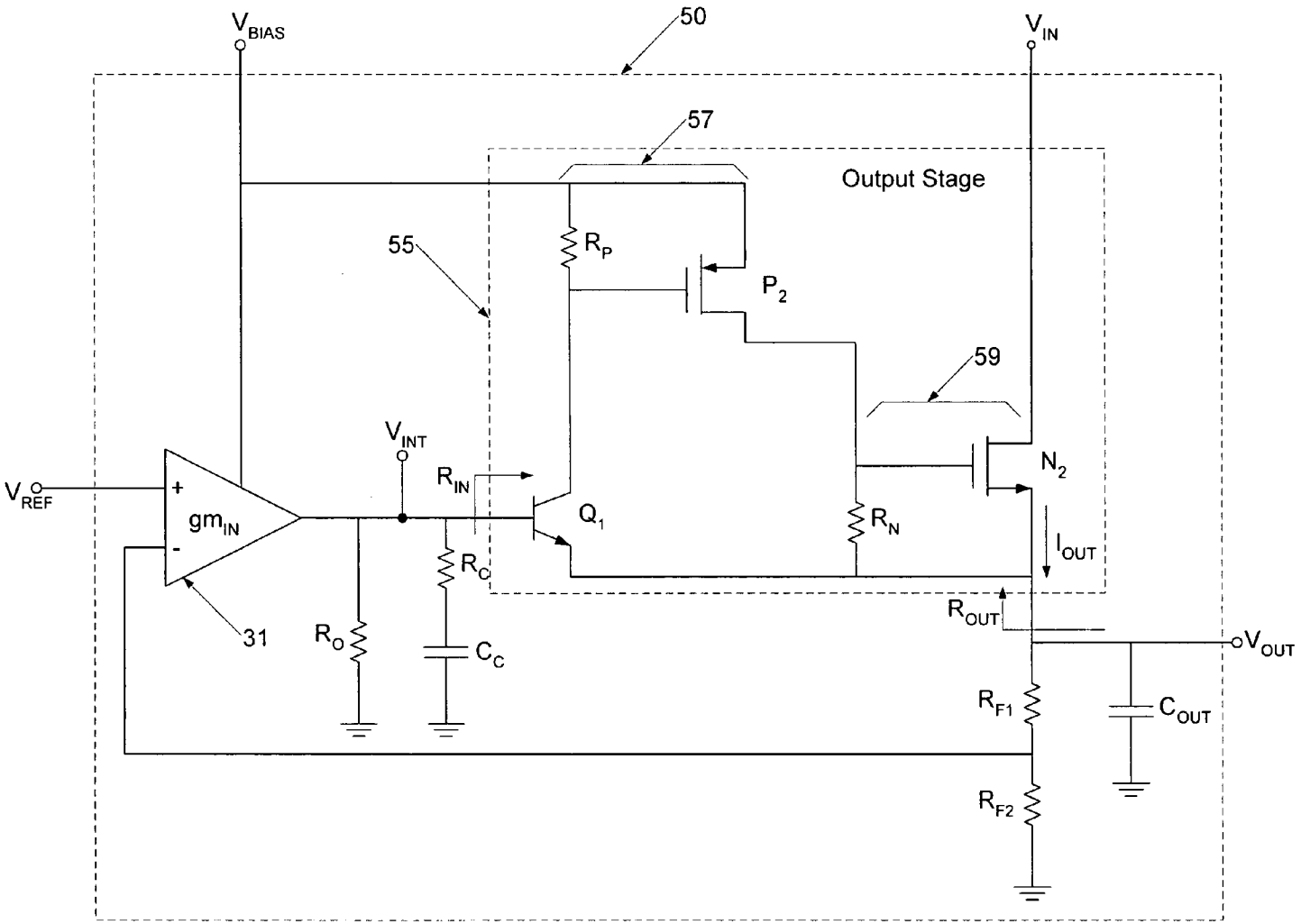

FIG. 5 shows another embodiment 50 of an LDO, which is generally similar to the embodiment 30 of FIG. 1, but does not utilize current mirrors in the output stage 55. Essentially, in circuit 57, a resistor $R_P$ has been substituted for the transistor P1; and in circuit 59, a resistor $R_N$ has been substituted for the transistor N1. Current mirrors as in FIGS. 1 and 4 are preferred, as the use of current mirrors creates a constant open loop gain in the output stage and is easy to set up and prove stability. The circuit using resistors can produce substantially similar results, however, adding the resistors means that current gain is not constant, so more effort must be expended to ensure stability of the output stage loop. Otherwise, the LDO 50 is the same as the LDO 30, and like components are identified by the same reference characters.

Figure 6:
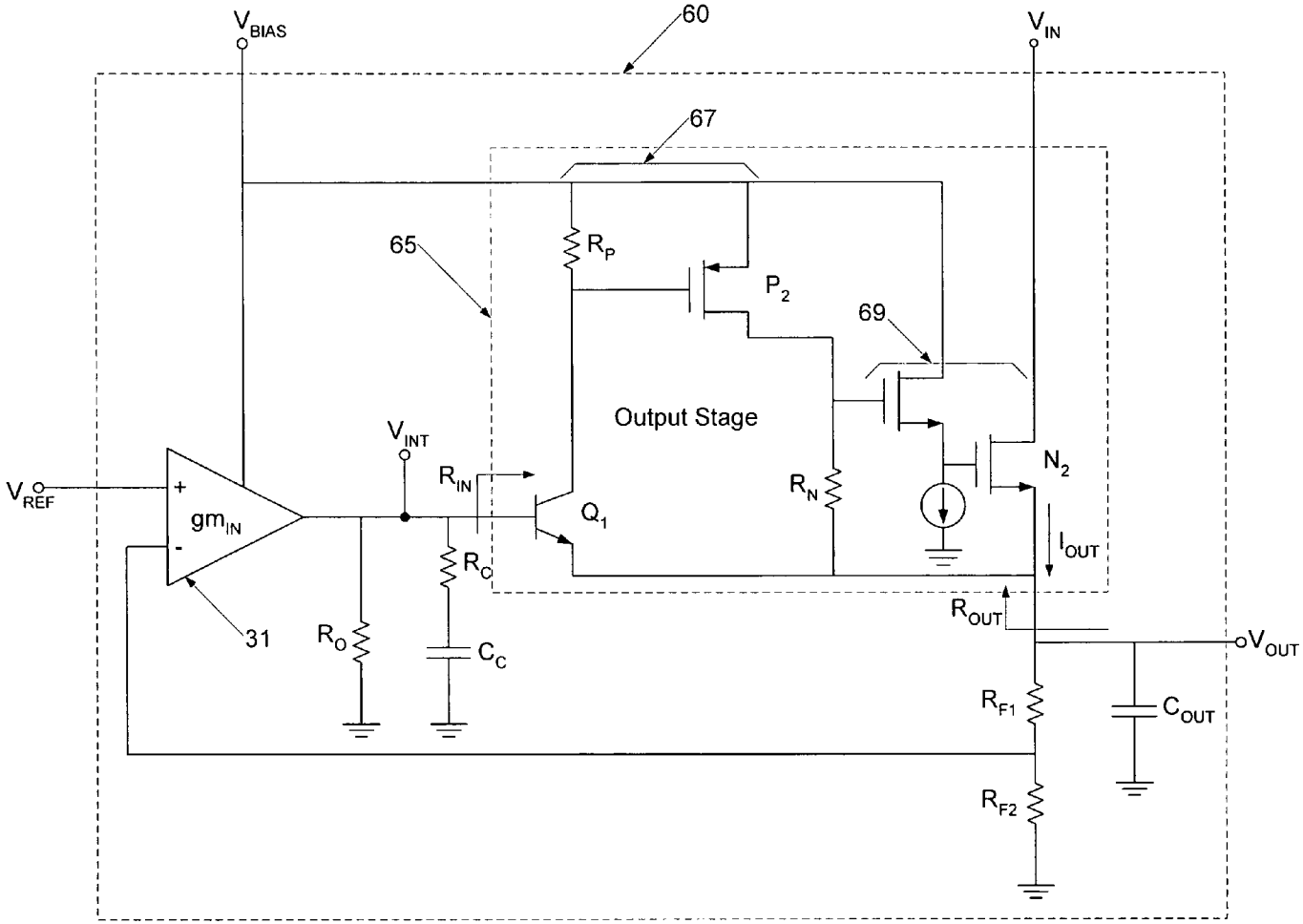

FIG. 6 shows another embodiment 60 of an LDO, which is generally similar to the embodiment 50 of FIG. 5, and like components are identified by the same reference characters. For example, like the LDO 50, the LDO 60 does not utilize current mirrors, and instead uses resistors in the circuits 67, 69. The LDO design 60, however, goes a step further by providing a low impedance follower in the circuit 69 to drive the high capacitance load of the large output NMOS ($N_2$). The bias current through the follower driving $N_2$ is selected to push the pole of gate of $N_2$ out beyond cross over. In both resistor circuit cases (FIGS. 5 and 6), the $I_{bias}$ of FIGS. 1 and 4 is not needed as a fixed amount of current is required to turn on $P_2$ and $N_2$ (namely $V_{gs}(P_2)/R_p$).

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A voltage regulator receiving an input voltage and operative over a specified range of output capacitances at a load comprising:

a control circuit responsive to load voltage for generating an error signal indicative of a difference thereof from a reference voltage; and an output stage responsive to the error signal for providing regulated voltage to the load, the output stage comprising:

(a) a metal oxide semiconductor (MOS) pass transistor having a source and a drain coupled between an input voltage source and the load and having a gate for controlling voltage drop across the MOS pass transistor to provide the regulated voltage at the load; and (b) an input transistor circuit responsive to the error signal and coupled to control operation of the MOS pass transistor, the input transistor circuit presenting a shunt impedance to the error signal for values of output capacitances within a portion of the range of output capacitances so as to stabilize closed loop gain of the voltage regulator for output capacitances within that portion.

2. The voltage regulator as in claim 1, wherein:

the input transistor circuit comprises a bipolar junction transistor (BJT) having a base receiving the error signal; and the base-emitter resistance of the BJT provides the shunt impedance for the values of output capacitances within the portion of the range of output capacitances.

3. The voltage regulator as in claim 2, wherein:

the output stage comprises at least one current mirror circuit responsive to operation of the BJT transistor, coupled between a source of the input voltage and the load, and the MOS pass transistor is an element of at least one current mirror circuit.

4. The voltage regulator as in claim 3, wherein at least one current mirror circuit comprises a PMOS current mirror and an NMOS current mirror.

5. The voltage regulator as in claim 3, wherein:

the control circuit includes an integrator for supplying the error signal to the base of the BJT transistor, and the emitter of the BJT transistor is connected to a node of the output stage supplying the regulated voltage to the load.

6. The voltage regulator as in claim 1, wherein the input transistor circuit comprises:

a metal oxide semiconductor (MOS) transistor having a gate receiving a signal related to the error signal; and a series resistance and capacitance, forming the shunt impedance, connected to the gate of the MOS transistor of the input transistor circuit.

7. The voltage regulator as in claim 6, wherein:

the output stage comprises at least one current mirror circuit responsive to operation of the MOS transistor of the input transistor circuit, coupled between the input voltage and the load, and the MOS pass transistor is an element of the at least one current mirror circuit.

8. The voltage regulator as in claim 7, wherein:

the at least one current mirror circuit comprises a PMOS current mirror and an NMOS current mirror, and the MOS pass transistor comprises an NMOS transistor of the NMOS current mirror.

9. The voltage regulator as in claim 8, wherein the MOS transistor of the input transistor circuit is an NMOS transistor.

10. The voltage regulator as in claim 1, wherein:

the control circuit comprises a transconductance amplifier; and the output stage provides unity gain.

11. The voltage regulator as in claim 10, wherein the control circuit further comprises an integrator coupled between an output of the transconductance amplifier and the input transistor circuit.

12. The voltage regulator as in claim 1, wherein the output stage comprises at least one resistor-transistor circuit.

13. The voltage regulator as in claim 12, wherein the MOS pass transistor is an element of the at least one resistor-transistor circuit.

14. The voltage regulator as in claim 13, wherein the at least one resistor-transistor circuit containing the MOS pass transistor also includes a low impedance transistor-follower circuit coupled to drive the gate of the MOS pass transistor.

15. A voltage regulator, comprising:

a control circuit for monitoring a voltage proportional to a load voltage and generating an error signal indicative of a difference thereof from a reference voltage; and an output stage responsive to the error signal for providing a regulated voltage to the load, the output stage comprising:

(a) a metal oxide semiconductor (MOS) pass transistor having a source and a drain coupled between a source of the input voltage and the load and having a gate for controlling voltage drop across the MOS pass transistor to provide regulated voltage to the load; and (b) an input transistor comprising a bipolar junction transistor (BJT) having a base receiving the error signal and being coupled to control the MOS pass transistor.

16. The voltage regulator as in claim 15, wherein:

the output stage comprises at least one current mirror circuit responsive to operation of the BJT transistor, coupled between the source of input voltage and the load, and the MOS pass transistor comprises an element of at least one current mirror circuit.

17. The voltage regulator as in claim 16, wherein the at least one current mirror circuit comprises a PMOS current mirror and an NMOS current mirror.

18. The voltage regulator as in claim 15, wherein:

the control circuit comprises a transconductance amplifier; and the output stage provides unity gain.

19. The voltage regulator as in claim 18, wherein the control circuit further comprises an integrator coupled between an output of the transconductance amplifier and the base of the BJT transistor.

20. The voltage regulator as in claim 15, wherein:

the output stage comprises at least one resistor-transistor circuit; and the MOS pass transistor is an element of at least one resistor-transistor circuit.

21. The voltage regulator as in claim 20, wherein the at least one resistor-transistor circuit containing the MOS pass transistor also includes a low impedance transistor-follower circuit coupled to drive the gate of the MOS pass transistor.

22. A voltage regulator operative over a specified range of output capacitances comprising:

an amplifier coupled to receive regulated load voltage;

an integrator responsive to an output of the amplifier for providing an error signal, wherein the integrator is configured to stabilize closed loop gain of the voltage regulator for output capacitance values within a first portion of the specified range of output capacitances; and a unity gain output stage coupled to an input voltage source for supplying the regulated voltage to the load in response to the error signal, wherein the unity gain output stage is configured to stabilize the closed loop gain of the voltage regulator for output capacitance values in a second portion of the specified range of capacitance values higher than the first portion.

23. A circuit coupled to an input signal source and configured for responsively producing an output signal, comprising:

a greater than unity gain amplifier coupled to the output signal;

an integrator coupled to an output of the amplifier; and an output stage buffer for processing the input signal in response to a signal from the integrator, to supply the output signal to a load, wherein:

the integrator is configured to stabilize the closed loop gain of the circuit over a first portion of a specified range of load capacitances; and the output stage buffer is configured to stabilize closed loop gain of the circuit over a second portion of the specified range of capacitances higher than the first portion.

24. The circuit of claim 23, wherein the output stage buffer comprises:

(a) a pass transistor, coupled between the input signal and the load and having an input, for controlling the voltage drop across the pass transistor to provide the output signal at the load; and (b) a stabilizing circuit, responsive to the signal from the integrator and coupled to the pass transistor, for stabilizing the output signal over the range of output capacitance.

25. The circuit as in claim 24, wherein the stabilizing circuit comprises an input transistor circuit responsive to the signal from the integrator and configured to shunt the signal from the integrator, for a portion of the range of output capacitance.

26. The circuit as in claim 25, wherein the stabilizing circuit further comprises:

a first current mirror circuit coupled between the input transistor circuit and a bias voltage for providing a first current gain; and a transistor coupled to the pass transistor to form a second current mirror, responsive to a current from the first current mirror, and coupled between the input signal and the load to provide a second current gain.

27. The circuit as in claim 26, wherein:

the input transistor circuit comprises a bipolar junction transistor (BJT) having a base receiving the signal from the integrator, a collector coupled to the first current mirror and an emitter coupled to the output signal at the load, a base-emitter resistance of the BJT transistor providing the shunt of the signal from the integrator; and the pass transistor comprises a metal oxide semiconductor (MOS) transistor.

28. The circuit as in claim 25, wherein:

the input transistor circuit comprises a metal oxide semiconductor (MOS) transistor, and a shunt circuit coupled to shunt the signal from the integrator around the MOS transistor for the portion of the range of output capacitance; and the pass transistor comprises a MOS transistor.

29. The circuit as in claim 28, wherein the shunt circuit comprises series connected resistance and capacitance.

30. The circuit as in claim 24, wherein:

the stabilizing circuit comprises at least one resistor-transistor circuit; and the pass transistor is an element of the at least one resistor-transistor circuit.

31. The circuit as in claim 30, wherein the at least one resistor-transistor circuit containing the pass transistor further includes a low impedance transistor-follower circuit coupled to drive the input of the pass transistor.

32. A circuit operative throughout a specified range of output capacitances, and supplying an output signal to a load, comprising:

an amplifier for monitoring a voltage proportional to the output signal load to generate an error signal indicative of a difference thereof from a reference voltage; and a buffer, responsive to the error signal, to supply the output signal, the buffer comprising:

(a) a metal oxide semiconductor (MOS) pass transistor having a source and a drain coupled between the input signal and the load and having a gate for controlling voltage drop across the MOS pass transistor; and (b) an input transistor circuit responsive to the error signal, coupled to control operation of the MOS pass transistor, the input transistor circuit presenting a shunt impedance to the error signal for values of output capacitances in a portion of the range of output capacitances so as to stabilize closed loop gain over that portion of the range.

33. The circuit as in claim 32, wherein:

the input transistor circuit comprises a bipolar junction transistor (BJT) having a base receiving the error signal; and the base-emitter resistance of the BJT provides the shunt impedance for values of output capacitance in the portion of the range.

34. The circuit as in claim 32, wherein the input transistor circuit comprises:

a metal oxide semiconductor (MOS) transistor having a gate receiving the error signal; and a series resistance and capacitance forming the shunt impedance for values of output capacitances in the portion of the range of output capacitances.

35. The circuit as in claim 32, wherein:

the amplifier comprises a transconductance amplifier; and the output stage buffer is of unity gain.

36. The circuit as in claim 35, further comprising an integrator coupled to an output of the transconductance amplifier for supplying the error signal to the input transistor circuit.

37. The circuit as in claim 32, wherein:

the output stage buffer comprises at least one resistor-transistor circuit; and the MOS pass transistor is an element of at least one resistor-transistor circuit.

38. The circuit as in claim 37, wherein the at least one resistor-transistor circuit containing the MOS pass transistor further includes a low impedance transistor-follower circuit coupled to drive the gate of the MOS pass transistor.

39. A circuit for supplying an output signal to a load, comprising:

an amplifier for monitoring a voltage proportional to the output signal, to generate an error signal indicative of a difference thereof from a reference voltage;

an integrator coupled to receive the error signal and producing an integrated error signal;

an output stage responsive to the integrated error signal for producing the output signal, the output stage comprising:

(a) a metal oxide semiconductor (MOS) pass transistor having a source and a drain coupled between the input signal and the output and having a gate for controlling voltage drop across the MOS pass transistor to provide the output signal; and (b) a bipolar junction transistor (BJT) having a base receiving the integrated error signal, coupled to control operation of the MOS pass transistor.

* * * * *